United States Patent [19]

Bollinger et al.

[11] Patent Number: 4,465,045

[45] Date of Patent: Aug. 14, 1984

[54] PULSED BLEED AIR THROTTLE POSITION CONTROLLER

[75] Inventors: Steven R. Bollinger, Creve Coeur; Thomas D. Vaughn, Ballwin, both of Mo.

[73] Assignee: ACF Industries, Inc., New York, N.Y.

[21] Appl. No.: 405,999

[22] Filed: Aug. 6, 1982

[51] Int. Cl.[3] ..... F02D 9/02

[52] U.S. Cl. ..... 123/360; 123/401

[58] Field of Search ..... 123/339, 352, 353, 354, 123/360, 361, 399, 401

[56] References Cited

U.S. PATENT DOCUMENTS 4,274,376 6/1981 Tsiang et al. ..... 123/360

FOREIGN PATENT DOCUMENTS 2072753 10/1981 United Kingdom ..... 123/339

*Primary Examiner*—Tony M. Argenbright

*Attorney, Agent, or Firm*—J. Joseph Muller

[57] ABSTRACT

Apparatus for controlling the idle speed of an internal combustion engine. A contact arm contacts a throttle lever to limit movement of the lever in one direction and to move the lever in the opposite direction so to control the position of a carburetor throttle valve. A vacuum operated unit maintains the contact arm at one position and moves it from one position to another. The vacuum pressure at which the vacuum unit operates is modulated by an electrically operated solenoid to maintain the contact arm in one position when the vacuum pressure is maintained at one level. The contact arm is moved to a new position when the solenoid operates to change the vacuum pressure to a different level.

4 Claims, 3 Drawing Figures

PULSED BLEED AIR THROTTLE POSITION CONTROLLER

BACKGROUND OF THE INVENTION

This invention relates to apparatus for controlling the idle speed of an internal combustion engine and more particularly to a vacuum operated unit for obtaining such control.

It is advantageous to control the position at which a carburetor throttle valve is allowed to close when an engine on which the carburetor is mounted is idling. This is because engine idle speed is thus controlled which helps improve both fuel economy and reduce exhaust emissions. Various devices are available for controlling engine idle, among these being the devices shown in U.S. Pat. Nos. 4,067,306 and 4,315,174 both of which are assigned to the same assignee as the present application. The devices shown in these patents as well as the subject of the present application are used in conjunction with an electronic feedback system to achieve idle speed control. In addition to the advantages noted above, use of these devices effectively tamperproofs the idle speed system of the carburetor to prevent adjustment of engine idle speed by modifying the carburetor after it leaves the manufacturers.

SUMMARY OF THE INVENTION

Among the several objects of the present invention may be noted the provision of a pulsed bleed air throttle position controller for automatically controlling the idle speed of an internal combustion engine; the provision of such a controller utilizing vacuum and air to control engine idle speed; the provision of such a controller which interfaces with an automobile's electronic feedback system to control engine idle speed; and, the provision of such a controller which eliminates the need for a carburetor fast idle cam and associated linkages while still providing a constant idle speed throughout engine warmup.

Briefly, apparatus of the present invention is for use with a carburetor mounted on an internal combustion engine can control the idle speed of the engine. The carburetor has a throttle valve mounted on a rotatable shaft to one end of which is secured a lever for rotating the shaft and moving the throttle valve. The apparatus comprises a contact arm contacting the lever to limit movement of the lever in one direction and to move the lever in the opposite direction thereby to control the position of the throttle valve when the engine is idling. A vacuum unit operates under vacuum pressure to maintain the contact arm at one position and to move the contact arm from one position to another. An electrically operated unit modulates the vacuum pressure at which the vacuum unit operates thus for the vacuum unit to maintain the contact arm in one position when vacuum pressure is maintained at one level and to move the contact arm to a new position when the electrically operated unit changes the vacuum pressure to a different level. Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
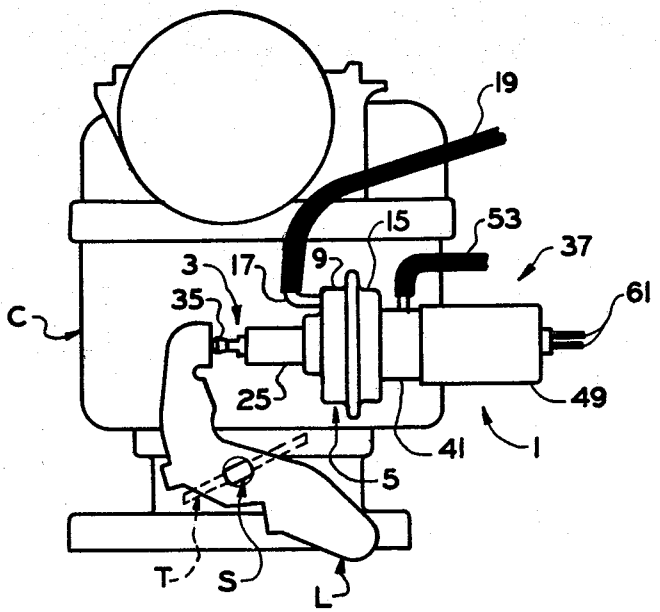
FIG. 1 is a side elevational view of a carburetor and the apparatus of the present invention for controlling engine idle speed.

Referring to the drawings, apparatus 1 of the present invention is for use with a carburetor C mounted on an internal combustion engine (not shown) to control the idle speed of the engine. Carburetor C has a throttle valve T mounted on a rotatable shaft S. A throttle lever L is secured to one end of shaft S. As is well known in the art, movement of throttle lever L produces rotation of shaft S to move throttle valve T. The throttle valve is opened when the engine is accelerated and substantially closed when the engine is at idle.

Apparatus or engine idle speed controller 1 comprises a means 3 contacting lever L to limit movement of the lever in one direction and to move the lever in the opposite direction. By controlling the position at which throttle valve T is maintained while the engine is at idle, the idle speed of the engine can be controll-d at a desired revolutions per minute (rpm).

Figure 2:
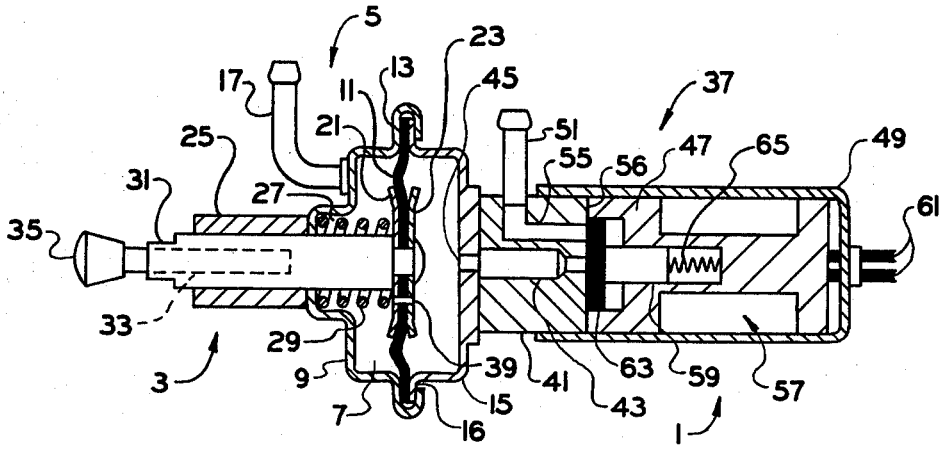
FIGS. 2 and 3 are side elevational views, in section, of the apparatus of the present invention illustrating two different operational positions of the apparatus.
Figure 3:
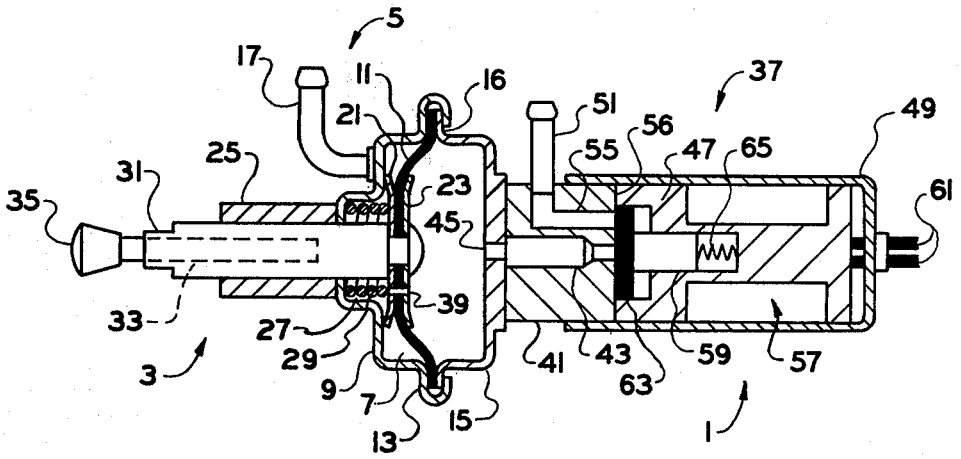

Apparatus 1 further includes a vacuum means 5 operating under vacuum pressure for maintaining the contact means in one position and for moving the contact means from one position to another. Vacuum means 5 comprises means defining a vacuum chamber 7 communicating with a vacuum source (not shown) to create a vacuum pressure in the chamber. Vacuum means 5 includes a cup-shaped housing 9 open at one end. A flexible diaphragm 11 covers the open end of the housing and the space enclosed by the side walls of the housing and the diaphragm constitutes vacuum chamber 7. As shown in FIGS. 2 and 3, housing 9 has an outwardly turned circumferential rim 13 against which the outer margin of diaphragm 11 abuts. A second cup-shaped housing unit 15 also has an outwardly turned circumferential rim 16 against which the other side of the outer margin of diaphragm 11 abuts. Rim 13 of housing 9 is spun or crimped over the rim 16 of housing 15 to secure diaphragm 11 in place. Housing 9 has an opening in its base in which is fitted an inlet tube 17. A coupling 19 (see FIG. 1) is connected to tube 17 and also to a vacuum source (not shown). Vacuum chamber 17 is exposed to vacuum communicated to vacuum means 5 by the tubing. Diaphragm 11 is sandwiched between a pair of backing plates 21 and 23 respectively. The central base portion of housing 9 is outwardly turned to form an elongate, cylindrical guide section 25. A shoulder 27 is formed at the inner end of guide 25 and a bias spring 29 seats against shoulder 27 and bears against diaphragm backing plate 21. Bias spring 29 urges diaphragm 11 to the right as shown in FIGS. 2 and 3 while the vacuum pressure in chamber 7 draws the diaphragm to the left as shown in the figures. Consequently, the position of diaphragm 11 at any one time is determined by the force of spring 29 and the vacuum pressure present within chamber 7.

Contact means 3 includes an extendible and retractable contact arm 31 sized to fit in guide 25. Contact arm 31 has a hollow threaded bore 33 extending inwardly from its outer end. A contact member 35 is threadably received in bore 33 and the outer end of contact member 35 contacts throttle lever L. The inner end of contact arm 31 is attached to diaphragm 11 in any convenient manner for the contact arm to move with the diaphragm as it flexes to the left or to the right.

Apparatus 1 next includes electrically operated means 37 for modulating the vacuum pressure at which vacuum unit 5 operates. This permits vacuum unit 5 to maintain contact arm 31 in one position when the vacuum pressure is maintained at one pressure level and for the vacuum unit to move the contact arm to a new position when means 37 changes the vacuum pressure to a different pressure level. As shown in FIGS. 2 and 3, diaphragm 11 has an air bleed 39 therethrough and means 37 includes means defining an air passage by which air is introduced into vacuum chamber 7 through bleed 39. For this purpose, means 37 includes an air flow block 41 having a central bore 43. Housing 15 has an air flow restriction 45 communicating with one end of bore 43 and the opposite end of bore 43 is of a reduced diameter to also create an air flow restriction. The right end of bore 43 opens into an air chamber 47 which is defined by a cylindrical housing 49. An air tube 51 enters the side of air flow block 41 and is connected to an air source (not shown) via a flexible tubing 53 (see FIG. 1). An air passage 55 formed in block 41 allows air entering tube 51 to flow into chamber 47. Both the outlet of passage 55 and the inlet of bore 43 are in a common wall 56 of block 43. Consequently, air entering block 41 through inlet tube 51 is communicated to vacuum chamber 7 via passage 55, air chamber 47, flow passage 43, restriction 45, and air bleed 39 in diaphragm 11.

To modulate the vacuum pressure in chamber 7, electrically operated means 37 includes a solenoid 57. Solenoid 57 is an on-off type solenoid having a movable armature 59. Solenoid 57 is energized via electrical signals routed to apparatus 1 by a pair of electrical leads 61. Armature 59 extends into air chamber 47 and the outer end of the armature has a sealing pad 63 the size of which is sufficient to simultaneously cover both the inlet of bore 43 and the outlet of air passage 55. Solenoid 57 includes a bias spring 65 acting on armature 59 to urge the armature to the left as shown in FIGS. 2 and 3. Pad 63 bears against wall 56 at the urging of spring 65 to block flow of air from passage 55 to bore 43. When solenoid 57 is energized, armature 59 moves to the right as shown in FIGS. 2 and 3 thus opening the air path between passage 55 and bore 43 and permitting air to flow from inlet 51 to vacuum chamber 7.

Solenoid 57 is supplied electrical pulses from a controller (not shown) whose function is to monitor various engine operating parameters and, as is well known in the art, supply pulses at a variable frequency rate to solenoid 57. When no pulse is supplied to the solenoid, armature 59 is at its first position blocking flow of air to vacuum chamber 7; while, when a pulse is supplied to the solenoid the armature is moved to its second or right hand position unblocking the air path to vacuum chamber. As a result, the amount of bleed air flowing through the air path is a function of the frequency with which pulses are supplied to solenoid 57. If the frequency rate of the pulses is low, apparatus 1 will have the condition shown in FIG. 3. In this condition, a high pressure level is present in vacuum chamber 7 and diaphragm 11 is drawn to an extreme left hand position. If on the other hand, the frequency rate of the pulses supplied to the solenoid is high, more air is bled into chamber 7 and apparatus 1 assumes the condition shown in FIG. 2 where spring 29 has urged diaphragm 11 toward the right. It will be understood, that the positions shown in FIGS. 2 and 3 are examples only and that the apparatus can assume a range of positions depending upon the frequency rate of the pulses supplied to solenoid 57.

In view of the above, it will be seen that the several objects of the invention are achieved and other advantageous results obtained.

As various changes could be made in the above constructions without departing from the scope of the invention, it is intended that all matter contained in the above description and shown in the accompanying drawing shall be interpreted as illustrative and not in a limiting sense.

What is claimed is:

1. Apparatus for use with a carburetor mounted on an internal combustion engine to control the idle speed of the engine, the carburetor having a throttle valve mounted on a rotatable shaft to one end of which is secured a lever for rotating the shaft and moving the throttle valve, the apparatus comprising:

means contacting the lever to limit movement of the lever in one direction and to move the lever in the opposite direction thereby to control the position of the throttle valve when the engine is idling;

guide means for guiding movement of the contact means;

vacuum means operating under vacuum pressure for maintaining the contact means at one position and for moving the contact means from one position to another, the vacuum means including a chamber exposed to vacuum; and electrical means for bleeding air to the chamber to modulate the vacuum pressure therein, the electrical means including an air passage communicating with the chamber and means controlling flow of air through the passage thereby to maintain the vacuum in the chamber at one level and to change it from one level to another, the electrical means including an air flow block having a central bore therein with flow restrictions at each end of the central bore, and a passage for introducing outside air into the apparatus, the outlet of the passage and the inlet of the central bore being in a common wall of the air flow block.

2. The apparatus of claim 1 wherein the electrical means further includes a solenoid having an armature movable from a position blocking air flow to the chamber to a position unblocking air flow.

3. The apparatus of claim 2 wherein the vacuum means includes a housing open at one end and a flexible diaphragm covering the open end of the housing, the housing having an diaphragm defining the vacuum chamber and the diaphragm having a bleed hole therethrough by which air is bleed into the chamber.

4. The apparatus of claim 3 where the contacting means comprises an extendible and retractable contact arm one end of which contacts the throttle lever and the other end of which is attached to the diaphragm, movement of the diaphragm in response to vacuum pressure changes moving the contact arm from one position to another.

* * * * *